US005346609A

United States Patent [19]

Fletcher et al.

[11] Patent Number: 5,346,609

[45] Date of Patent: Sep. 13, 1994

[54] HYDROCARBON UPGRADING PROCESS

[75] Inventors: David L. Fletcher, Turnesville; Michael S. Sarli, Haddonfield; Stuart S. Shih, Cherry Hill, all of N.J.

[73] Assignee: Mobil Oil Corporation, Fairfax, Va.

[21] Appl. No.: 745,311

[22] Filed: Aug. 15, 1991

[51] Int. Cl.[5] ..... C10G 69/02

[52] U.S. Cl. ..... 208/89; 208/212; 208/213

[58] Field of Search ..... 208/58, 89, 212, 213

[56] References Cited

U.S. PATENT DOCUMENTS

| | | | |
|---|---|---|---|
| 3,458,433 | 7/1969 | Wood et al. | 208/89 |
| 3,549,513 | 12/1970 | Brainard | 208/89 |
| 3,549,515 | 12/1970 | Brainard et al. | 208/89 |
| 3,663,424 | 5/1972 | Jaffe | 208/89 |
| 3,728,251 | 4/1973 | Kelley et al. | 208/89 |
| 3,729,409 | 4/1973 | Chen | 208/35 |
| 3,759,821 | 9/1973 | Brennan et al. | 208/93 |
| 3,763,032 | 10/1973 | Banks | 208/93 |
| 3,767,568 | 10/1973 | Chen | 208/134 |
| 3,923,641 | 12/1975 | Morrison | 208/111 |
| 3,950,242 | 4/1976 | Garwood et al. | 208/92 |
| 3,957,625 | 5/1976 | Orkin | 208/211 |
| 4,049,542 | 9/1977 | Gibson et al. | 208/213 |
| 4,057,488 | 11/1977 | Montagana | 208/89 |
| 4,062,762 | 12/1977 | Howard et al. | 208/211 |
| 4,132,632 | 1/1979 | Yu et al. | 208/216 |
| 4,140,626 | 2/1979 | Bertolacini et al. | 208/216 R |
| 4,171,257 | 10/1979 | O'Bear et al. | 208/120 |
| 4,190,519 | 2/1980 | Miller et al. | 208/79 |
| 4,210,521 | 7/1980 | Gornny et al. | 208/89 |
| 4,251,348 | 2/1981 | O'Rear et al. | 208/61 |
| 4,282,085 | 8/1981 | O'Rear et al. | 208/120 |
| 4,370,219 | 1/1983 | Miller | 208/59 |
| 4,390,413 | 6/1983 | O'Rear et al. | 208/61 |
| 4,400,265 | 8/1983 | Shen | 208/97 |
| 4,738,766 | 4/1988 | Fischer et al. | 208/68 |
| 4,753,720 | 6/1988 | Morrison | 208/70 |
| 4,764,266 | 8/1988 | Chen et al. | 208/58 |
| 4,784,745 | 11/1988 | Nace | 208/74 |
| 4,822,477 | 4/1989 | Avidan et al. | 208/70 |
| 4,827,076 | 5/1989 | Kokoyeff et al. | 208/212 |
| 4,859,308 | 8/1989 | Harandi et al. | 208/49 |
| 4,959,140 | 9/1990 | Kukes et al. | 208/59 |
| 4,975,400 | 12/1990 | Inoue et al. | 502/66 |
| 5,000,839 | 3/1991 | Kirker et al. | 208/89 |
| 5,143,596 | 9/1992 | Maxwell et al. | 208/89 |

*Primary Examiner*—Helane Myers

*Attorney, Agent, or Firm*—A. J. McKillop; M. D. Keen

[57] ABSTRACT

A process for producing a desulfurized gasoline boiling range product of relatively high octane number from a sulfur containing feed boiling in the naphtha boiling range by converting the feed in a first stage over a conventional hydrodesulfurization catalyst, and then converting at least the normally liquid portion of the product of this first stage conversion over a catalyst comprising a zeolitic behaving refractory solid having acid activity and shape selectivity to produce a product having a sulfur content within the required specifications, and an octane number which at least approaches the octane number of the feed.

18 Claims, 3 Drawing Sheets

HYDROCARBON UPGRADING PROCESS

This invention is directed to a process for the upgrading of hydrocarbon streams. It more particularly refers to a process for upgrading gasoline boiling range petroleum fractions containing substantial proportions of sulfur impurities.

BACKGROUND OF THE INVENTION

It is well known in the petroleum refining arts to catalytically crack heavy petroleum fractions, such as vacuum gas oil, or even in some cases atmospheric resid, in order to convert a substantial proportion thereof to a wide range of petroleum fractions. It is conventional to recover the product of catalytic cracking and to distill, and thereby resolve, this product into various fractions such as light gases; naphtha, including light and heavy gasoline; distillate fractions, such as heating oil and Diesel fuel; lube oil base fractions; and heavier fractions.

Where the petroleum fraction being catalytically cracked contains sulfur, the products of catalytic cracking will also likely contain sulfur impurities. In particular, it is well known that the heavy gasoline fraction is one portion of the product in which sulfur impurities seem to concentrate.

Therefore, it has been well known in the petroleum arts to subject this fraction to desulfurization processes. One such conventional, commercially known process is desulfurization by hydrotreating.

In one general type of conventional, commercial operation, the heavy gasoline is contacted with a suitable hydrotreating catalyst at elevated temperature and somewhat elevated pressure in the presence of a hydrogen atmosphere. One suitable family of catalysts which has been widely used for this service is a combination of a group VIII and a group VI element, such as cobalt and molybdenum, on a suitable substrate, such as for example alumina.

It is also well known that naphthas, often light or full range naphthas, are catalytically reformed so as to increase their octane numbers by converting at least a portion thereof to aromatics. Fractions to be fed to catalytic reforming, such as over a platinum type catalyst, for the purpose of upgrading their octane number, must also be desulfurized before reforming because the reforming catalyst is generally not sulfur tolerant. Thus, naphthas are usually pretreated to reduce their sulfur content before reforming.

Aromatics are generally the source of very high octane number, particularly very high research octane numbers. Therefore, while, on the one hand, they are quite desirable components of the gasoline pool, on the other hand, aromatics, and particularly benzene, have been the subject of severe limitations as a gasoline component because of its adverse effect upon the ecology.

To the extent that it is possible, it has become desirable to create a gasoline pool in which the higher octanes are contributed by the olefinic and branched chain paraffinic components, rather than the aromatic components. Light and full range naphthas can contribute substantial volume to the gasoline pool, but, without reforming, they do not have substantial octane to contribute.

In the hydrotreating of petroleum fractions, particularly naphthas, and most particularly heavy cracked gasoline, the molecules containing the sulfur atoms are mildly hydrocracked so as to release their sulfur, usually as hydrogen sulfide. After the hydrotreating operation is complete, the product may be fractionated, or even just flashed, to release the hydrogen sulfide and collect the now sweetened gasoline.

This is an excellent process that has been practiced on gasolines and heavier petroleum fractions for many years. It works well and produces a satisfactory product. However, it does have disadvantages.

Cracked naphtha, as it comes from the catalytic cracker and without any further treatments, such as purifying operations, has a relatively high octane number. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool. Therefore, it is a most desirable component of the gasoline pool, and it should not be lightly tampered with.

A substantial portion of the octane of cracked naphtha is due to the olefin content of the naphtha. Catalytic cracking is particularly adept at producing olefinic products which, in the gasoline boiling range, have very high octanes.

Other highly unsaturated fractions boiling in the gasoline boiling range, which are produced in some refineries or petrochemical plants, include pyrolysis gasoline. This is a fraction which is often produced as a by-product in the cracking of petroleum fractions to produce light unsaturates, such as ethylene and propylene. Pyrolysis gasoline has a very high octane number but is quite unstable because, in addition to the desirable olefins boiling in the gasoline boiling range, this fraction also is unstable because it contains a substantial proportion of diolefins.

Hydrotreating of any of the sulfur containing fractions which boil in the gasoline boiling range causes a reduction in the olefin content thereof, and therefore a reduction in the octane number thereof. While hydrotreating reacts hydrogen with the sulfur containing molecules in order to convert the sulfur and to remove such as hydrogen sulfide, as with any operation which reacts hydrogen with a petroleum fraction, the hydrogen does not only react with the sulfur as desired. Unfortunately, some of the hydrogen also tends to saturate at least some of the unsaturation in the molecules of the fraction being hydrotreated. Some of the hydrogen may also cause some hydrocracking as well as olefin saturation, depending on the conditions of the hydrotreating operation.

In any case, regardless of the mechanism by which it happens, hydrotreating not only removes harmful sulfur from the fraction being treated, but also lowers the octane number of that fraction. Further, as the degree of desulfurization increases, the octane number of the normally liquid gasoline boiling range product decreases. Therefore, in these days of relatively shorter supply of hydrocarbons, particularly sweet hydrocarbons, in view of the growing need to produce gasoline fuels with higher octane number, and because of current ecological considerations, that the a desire to produce cleaner burning fuels, there is a conflict between producing more and higher octane gasoline on the one hand, and producing gasoline having a lower sulfur content, which is therefore cleaner burning and less polluting to the atmosphere, on the other.

In a completely different area of petroleum refining, it is known, and it has been known for some time, that various acid acting zeolitic materials have great value in upgrading petroleum fractions. For example, commercially practiced catalytic cracking is substantially always carried out using a catalyst which comprises an acid acting zeolitic behaving refractory material as at least one of its components.

It is also well known, and widely practiced commercially, to catalytically upgrade distillate and lube oil base fractions of petroleum in order to remove waxy components therefrom and thus reduce their pour point, that is the lowest temperature at which they will still pour. This type of operation is often carried out with the aid of a dewaxing catalyst, which usually comprises as at least one of its important, active components, an intermediate pore sized zeolitic acting acidic refractory material.

The dewaxing of distillate and/or lube fractions is usually accomplished at elevated temperatures and somewhat elevated pressures, and usually in the presence of hydrogen. The usual intent is for the pressure under which the reaction is carried out, and the amount of hydrogen in the reaction zone, to be controlled such that the hydrogen acts predominantly to keep the coke make on the catalyst down, and not such that substantial hydrocracking is supported.

Actually, except for, in some cases, the amount of hydrogen and the reaction pressure, the operating conditions for processes of dewaxing of distillate and lube fractions are often quite similar to the operating conditions of a process for hydrodesulfurization by hydrotreating. The catalyst, however, is quite different.

The purpose of a hydrotreating operation is to convert the molecules containing the undesirable sulfur impurities so as to release the sulfur from the molecules as hydrogen sulfide. The purpose of a dewaxing operation is to mildly selectively crack the longer chain paraffinic and near paraffinic molecules in a higher boiling distillate or lube base fraction which are primarily responsible for the unacceptably high pour point of the fraction. This mild selective cracking converts these undesirable paraffinic molecules to lower boiling materials which are easily separated from the remaining distillate fraction, which now has a lower pour point. Suitably, dewaxing catalysts are acid acting zeolitic behaving materials which have restricted pore dimensions which will allow the ingress and egress of only selected size and shape molecules into their pore system. Since most, if not all, of the acid activity of these catalysts exists within their pore system, by limiting the access of feed molecules to these acidic cracking cites, only selected molecules of the feed are cracked.

A good dewaxing process will convert a minimum of the feed to lower boiling products. The intention and desire is to produce a product which has the highest possible yield in the distillate or lube oil boiling ranges, that is the boiling range of the feed material, while selectively removing as few as possible of those molecules which cause the pour point of the distillate or lube feed material to be higher than desired.

The operating conditions for dewaxing processes are usually selected so as to convert a minimum of the feed, consistent with the desired properties of the product. Further, since this operation is carried out under hydrogen pressure, and since at least some of the cracked product falls into the naphtha boiling range, the operating conditions are selected so as to accomplish as little olefin saturation as possible, again, consistent with the overall objective of lowering the pour point of the feed.

Suitable intermediate pore size zeolitic behaving catalytic materials are exemplified by those acid acting materials having the topology of intermediate pore size aluminosilicate zeolites. These similarly behaving zeolitic catalytic materials are exemplified by those which, in their acid form, have a Constraint Index between about 2 and 12. Reference is here made to U.S. Pat. No. 4,784,745 for a definition of Constraint Index and a description of how this value is measured. This patent also discloses a substantial number of porotectosilicate materials having the appropriate topology and the pore system structure to be useful in this service. The entirety of this patent is incorporated herein by reference.

It should be understood that these exemplary materials are particularly exemplary of the topology and pore structure of desired acid acting refractory solids. It is not intended that this patent be referred to as limiting the type of catalysts to be used for this service to aluminosilicates. Other compositions of refractory solid materials which have the desired acid activity, pore structure and topology are similarly well suited.

OBJECTS AND BROAD STATEMENT OF THIS INVENTION

An important object of this invention is therefore to provide a novel process for the treatment of sulfur containing gasoline boiling range fractions by which the sulfur content thereof is reduced to acceptable levels and the octane number thereof is not substantially reduced.

It is another object of this invention to provide a novel process for the treatment of sulfur containing gasoline boiling range fractions by which the sulfur content thereof is reduced to acceptable levels, the octane number thereof is at least not substantially reduced, the volumetric yield of gasoline boiling range product is also not substantially reduced, and the number of octane barrels of product produced is at least about equivalent to the number of octane barrels of feed introduced into the operation.

It is a further object of this invention to provide a novel process for the treatment of sulfur containing gasoline boiling range fractions by which the sulfur content thereof is reduced to acceptable levels, the octane number thereof is not substantially reduced, and the volumetric yield of gasoline boiling range product is actually increased.

It is a still further object of this invention to provide a novel process for the treatment of sulfur containing heavy, cracked gasoline boiling range fractions by which the sulfur content thereof is reduced to acceptable levels, the octane number thereof is not substantially reduced, or may in some cases actually be increased, and the volumetric yield of gasoline boiling range product is actually increased.

It is a still further object of this invention to provide a process of upgrading the octane number of light and full range naphtha fractions without the necessity of reforming such fraction, or at least, without the necessity of reforming such fractions to the degree previously thought necessary.

Other and additional objects of this invention will become apparent from a consideration of this entire specification and the claims appended hereto.

In accord with and fulfilling these objects, one important aspect of this invention is a process in which a sulfur containing gasoline boiling range fraction is hydrotreated, in a first stage, under conditions sufficient to separate at least a substantial proportion of the bound sulfur therefrom, and the product thereof is then converted, in a second stage, in effective contact with an acid acting, zeolitic behaving, refractory material of intermediate pore size which, if it was in an aluminosilicate form, would have a constraint index of about 2 to 12, under conditions which may be substantially those associated with the dewaxing of distillate or lube oil fractions, and/or may be those which are substantially the same as the conditions of hydrotreating. It is to be noted that, although it is stated that the conditions for the conversion of the desulfurized intermediate product by contact with the intermediate pore size refractory solid are those often associated with the dewaxing of distillate or lube oil fractions, this is only for the purposes of defining the operating conditions. It does not define the fractions being operated on, or the operation which is performed on that fraction, or the product produced thereby.

Therefore, according to this invention, a sulfur-containing gasoline boiling range fraction, suitably a light naphtha having a boiling range of about $C_6$ to 330° F., a full range naphtha having a boiling range of about $C_5$ to 420° F., a heavier naphtha fraction boiling in the range of about 260° F. to 412° F., or a heavy gasoline fraction boiling at, or at least within, the range of about 330° to 500° F., preferably about 330° to 412° F. are well suited to use as the feed to the process of this invention. While the most preferred feed appears at this time to be a heavy gasoline which has resulted from the catalytic cracking of a still heavier feed, such as a gas oil; or a light or full range gasoline boiling range fraction, this may change as the case may be and the need arises in the future. In any case, the suitably selected sulfur containing, gasoline boiling range feed is treated by:

converting such gasoline boiling range feed by effective contact thereof with a hydrotreating catalyst, which is suitably a conventional hydrotreating catalyst, such as a combination of a group VI and a group VIII metal on a suitable refractory support, such as for example an acidic support like alumina, under conventional hydrotreating conditions which are sufficient to separate at least some of the sulfur from the feed molecules and convert such to hydrogen sulfide, to produce a first intermediate product comprising a normally liquid fraction boiling in substantially the same boiling range as the feed, which is a gasoline boiling range, but which has a lower sulfur content than the feed and which has a lower octane number than the feed;

converting at least the fraction of this first intermediate product which boils in the gasoline boiling range, and which preferably has a boiling range which is not substantially higher than the boiling range of said feed, by effective contact with a catalyst, which suitably has substantial acid activity, and is a refractory solid having an intermediate effective pore size and the topology of a zeolitic behaving material, which, in the aluminosilicate form, has a constraint index of about 2 to 12, under conditions sufficient to produce a second intermediate product comprising at least a fraction which boils in the gasoline boiling range, and preferably has a boiling range which is not substantially higher than the boiling range of said feed, but which has a higher octane number than the portion of the first intermediate product fed to this second step; and recovering at least the gasoline boiling range fractions so produced.

PREFERRED ASPECTS OF THIS INVENTION

In practicing this invention, the suitable temperature of the first conversion is about 400° to 800° F., preferably about 500° to 750° F.; the pressure is about 50 to 1500 psig, preferably about 300 to 1000 psig; the space velocity is about 0.5 to 10 LHSV, preferably about 1 to 6 LHSV; and the hydrogen to hydrocarbon ratio in the feed is about 500 to 5000 SCF/B, preferably about 1000 to 2500 SCF/B. The catalyst has been stated to be a conventional desulfurization catalyst made up of a group VI and/or a group VIII metal on a suitable substrate. The group VI metal is usually molybdenum or tungsten. The group VIII metal is usually nickel or cobalt. However, other metals which have been known to be useful in this service are also to be included.

The particle size and the nature of the first conversion catalyst will usually be determined by the type of hydrotreating process which is being carried out, such as: a down-flow, liquid phase, fixed bed process; an upflow, fixed bed, trickle phase process; an ebulating, fluidized bed process; or a transport, fluidized bed process. All of these different process schemes are generally well known in the petroleum arts, and the choice of the particular mode of operation is a matter left to the discretion of the operator. All of these process schemes will work well in the practice of this invention.

In practicing this invention, the suitable temperature of the second conversion is about 300° to 900° F., preferably about 350° to 800° F.; the pressure is about 50 to 1500 psig, preferably about 300 to 1000 psig; the space velocity is about 0.5 to 10 LHSV, preferably about 1 to 6 LHSV; and the hydrogen to hydrocarbon ratio in the feed is about 0 to 5000 SCF/B, preferably about 100 to 2500 SCF/B. The catalyst has been stated to be a conventional dewaxing catalyst comprising an acid acting, zeolitic behaving refractory material. The zeolitic material portion of this catalyst suitably has the topology of ZSM-5, ZSM-11, ZSM-21, ZSM-22, ZSM-23, ZSM-35, ZSM-48, ZSM-50, MCM-22, mordenite, or other similarly structured materials.

The zeolitic behaving material may be used in pure form, that is without the aid of a binder or a substrate. However, it is usual that the particle sizes of the pure zeolitic behaving materials are too small to be of commercial value because of the pressure drop created by the use of very small particles as a catalyst bed. Therefore, it is more common for these zeolitic behaving materials to be used as an agglomerate with a suitable binder or disposed on a substrate. This binder or substrate, which is preferably used in this service, is suitably any refractory binder material. Examples of these materials are well known in the petroleum arts and include silica, silica-alumina, silica-zirconia, silica-titania, alumina, etc.

Although the zeolitic behaving material has been defined by relation to a group of porous refractory materials which are usually known in their aluminum-silicon-oxygen composition form, this is by no means limiting on the scope of this invention. These designations have been used to define the topology only, and not to restrict the composition, of the zeolitic behaving refractory solid catalyst components. The catalyst composition is, however, restricted to those comprising zeolitic behaving materials of the defined structures which have sufficient acid activity to have cracking activity with respect to the second intermediate fraction, defined above, that is, at least sufficient to convert at least a desired fraction of this material as feed.

One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The second stage catalyst of this invention should suitably have an alpha activity of at least about 20, preferably at least about 50 to 200. It is inappropriate for the second stage catalyst to have too high an acid activity because it is desirable to only crack and rearrange so much of the first intermediate product as is necessary to restore lost octane without severely reducing the volume of the gasoline boiling range product.

The particle size and the nature of the second conversion catalyst will usually be determined by the type of conversion process which is being carried out, such as: a down-flow, liquid phase, fixed bed process; an up-flow, fixed bed, liquid phase process; an ebulating, fixed fluidized bed liquid or gas phase process; or a liquid or gas phase, transport, fluidized bed process. As noted above, all of these different process schemes are, per se, well known in the petroleum arts, and the choice of the particular mode of operation is a matter left to the discretion of the operator.

It is well within the practice of this invention to carry out the two step conversion envisioned hereby in a cascade operation. That is, the first conversion is carried out as aforesaid, and the entire product thereof, without intermediate separation, is then subjected to the second conversion. At the conclusion of the second conversion, the product is separated into the usual fractions according to their boiling ranges and uses. The predominant fractions are: dry gas; LPG, that is $C_3$ and $C_4$ gases; and both heavy and light gasoline.

It is also within the intended practice of this invention, to carry out the two conversions in a single reaction zone by using a sequential catalyst bed system. As a general proposition, both of these reaction zone configurations are quite well known in the petroleum arts.

It is further within the scope of this invention to use two separate reaction zones operated in tandem, with intermediate separation of some of the intermediate fractions produced in the first stage operation. In this type of operation, the first conversion is carried out as aforesaid, and the product thereof is resolved, suitably by distillation or flashing, to separate the low sulfur, lower octane gasoline boiling range fraction produced the first intermediate product from the hydrogen sulfide and/or ammonia bi-products produced in the hydrodesulfurization operation. These undesirable components, notably hydrogen sulfide and ammonia, are separated for further disposal as is usual in petroleum refining.

The gasoline boiling range portion of the first intermediate product is then subjected to the second conversion as aforesaid, and the product thereof is separated into its gasoline boiling range fraction(s) and other, lighter fractions produced in the second stage conversion. Suitably, substantially all of the sulfur and nitrogen will have been removed from the feed in the first conversion, and the hydrogen sulfide and ammonia will have been removed for conventional disposal. However, if all of the sulfur is not removed in the first stage conversion, it is possible that additional hydrogen sulfide, or other undesirable components, will be produced in the second conversion as well. In this case, it is possible to combine the undesirable fractions, such as the sulfur containing fractions, resulting from the first and the second stage conversions and treat them together. It is also possible to combine the dry gas, if any, and the $C_3$ and $C_4$ fractions from both conversion stages and treat them together.

It is important that the conditions of operation and the catalysts which are chosen for use in this invention combine to produce a product slate in which the gasoline product octane is not substantially lower than the octane of the feed gasoline boiling range material; that is not lower by more than about 1 to 3 octane numbers. It is preferred that the catalysts and the operating conditions which are chosen for use in this invention are such that the volumetric yield of the product is not substantially diminished as compared to the feed. In some cases, the volumetric yield and/or octane of the gasoline boiling range product may well be higher than those of the feed. In many cases, the octane barrels (that is the octane number of the product times the volume of product) of the product will be higher than the octane barrels of the feed.

It is within the spirit and the scope of this invention to utilize the same or different operating conditions in the first and second conversion reaction zones. In the case where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

If it is desired to further increase the volumetric yield of the gasoline boiling range fraction of the product, and perhaps increase the octane number as well, particularly the motor octane number, the LPG ($C_3$'s and $C_4$'s) fraction of the product, particularly that fraction of the product of the second conversion zone, which is more olefinic, can be subjected to conventional alkylation processing, suitably with isobutane which has been made in this or a catalytic cracking process or which is imported from other operations, to convert at least some, preferably a substantial proportion, thereof to high octane gasoline boiling range product. This added alkylate fraction will surely increase both the octane and the volumetric yield of the total gasoline product. If alkylation is used as an adjunct process, the conditions of alkylation can be those which are conventionally used industrially in this process.

Figure 1:
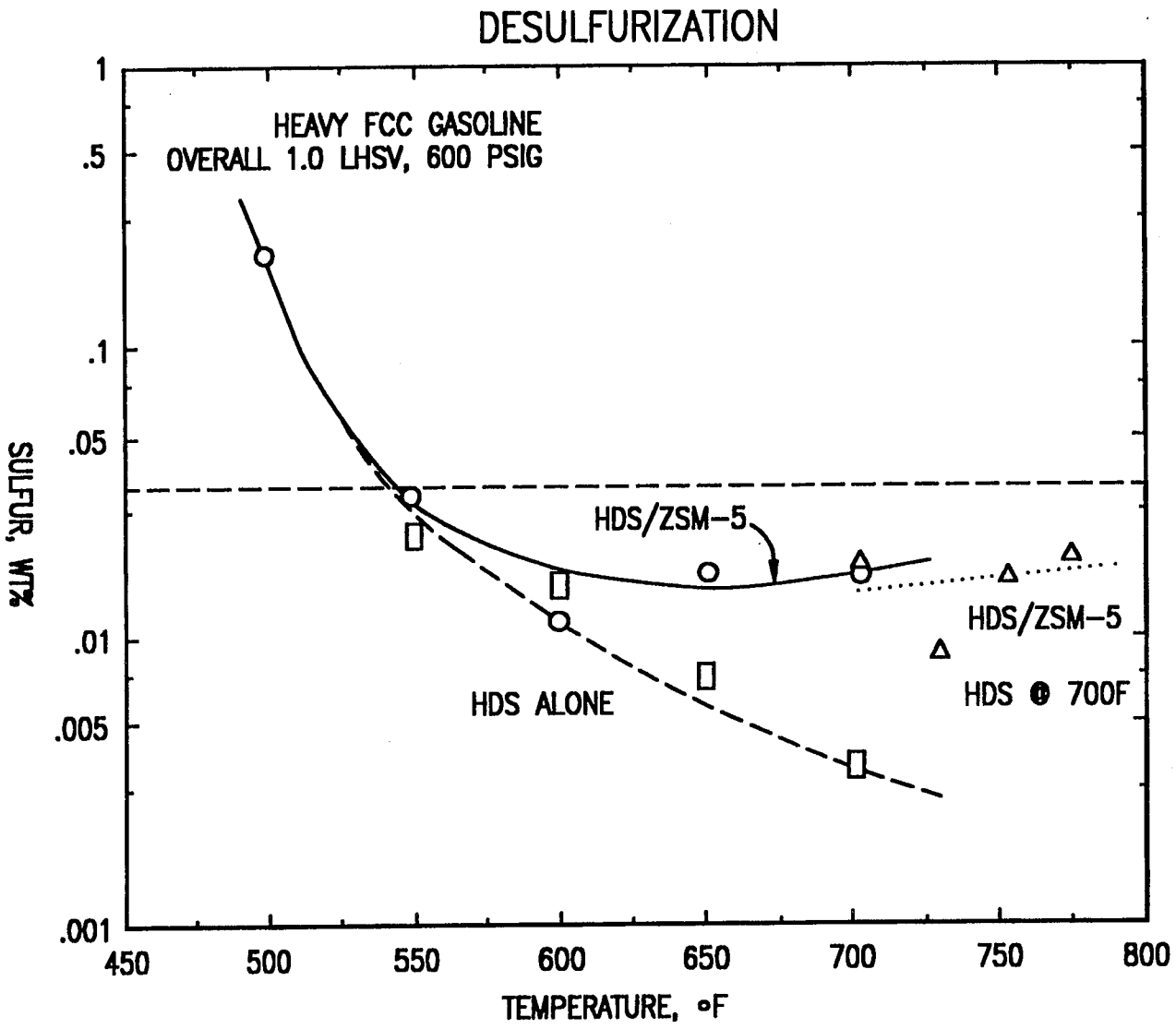
FIG. 1 is a series of plots of the sulfur content of the product as a function of the operating temperature of hydrotreating and second stage conversion.

Looking at the instant process from an overall perspective, it should be apparent that the feed gasoline boiling range material will have its sulfur content and its octane reduced, but its volumetric yield increased, in the first stage of this process; the first intermediate product of the first stage operation, without consideration of the bi-product hydrogen sulfide and ammonia, will have its volume reduced but its octane increased in the second stage conversion; and this second intermediate fraction will have its volume and its octane increased by having alkylate added back into it. In one example of the operation of this process, it is reasonable to expect that, with a heavy cracked naphtha feed, the first stage hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the first intermediate product by at least about 5%, and, if the sulfur content is high in the feed, that this octane reduction could go as high as about 15%.

The second stage of the instant process should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate.

The process of this invention should be operated under a combination of conditions such that the desulfurization should be at least about 50%, preferably at least about 75%, as compared to the sulfur content of the feed.

SPECIFIC EXAMPLES OF THE PRACTICE OF THIS INVENTION

The following examples are illustrative of the practice of this invention but are by no means restrictive on the scope thereof. In these examples, parts and percentages are by weight unless they are expressly stated to be on some other basis. Temperatures are in ° F and pressures in psig, unless expressly stated to be on some other basis.

In the following examples, unless it is indicated that there was some other feed, the same heavy cracked naphtha, containing 2% sulfur, was subjected to processing as set forth below under conditions required to allow a maximum of only 300 ppmw sulfur in the final gasoline boiling range product. In the following table 1 there are set forth the properties of the two catalysts used in the two operating conversion stages:

TABLE 1

| | Catalyst Properties | |
|---|---|---|
| | Hydrodesulfurization 1st stage Catalyst | ZSM-5(1) 2nd stage Catalyst |
| Chemical Composition, wt % | | |
| Nickel | — | 1.0 |
| Cobalt | 3.4 | — |
| $MoO_3$ | 15.3 | — |
| Physical Properties | | |
| Particle Density, g/cc | — | 0.98 |
| Surface Area, $m^2/g$ | 260 | 336 |
| Pore Volume, cc/g | 0.55 | 0.65 |
| Pore Diameter, A | 85 | 77 |

(1)contains 65 wt % ZSM-5 and 35 wt % alumina

In table 2 below, there is set forth the properties of the feed heavy cracked naphtha which was used in these examples:

TABLE 2

| Heavy FCC Naphtha | |
|---|---|
| Gravity, °API | 23.5 |
| Hydrogen, wt % | 10.23 |
| Sulfur, wt % | 2.0 |
| Nitrogen, ppmw | 190 |
| Clear Research Octane, R + O | 95.6 |
| Composition, wt % | |
| Paraffins | 12.9 |
| Cyclo Paraffins | 8.1 |
| Olefins and Diolefins | 5.8 |
| Aromatics | 73.2 |
| Distillation, °F. | |
| 5% | 289 |
| 10% | 355 |
| 30% | 405 |
| 50% | 435 |
| 70% | 455 |
| 90% | 482 |
| 95% | 488 |

The process of both stages of the following examples was carried out at the same conditions of: a pressure of 600 psig, a space velocity of 1 LHSV, and a hydrogen circulation rate of 3200 scf/bbl. The start of cycle temperature was 500° F. and the final temperature was 800° F. In all of the following examples, the process of this invention was operated in a cascade mode with both catalyst bed/reaction zones being operated at the same conditions and with no intermediate separation of the intermediate product of the hydrodesulfurization conversion stage.

PRIOR ART EXAMPLES

Figure 2:
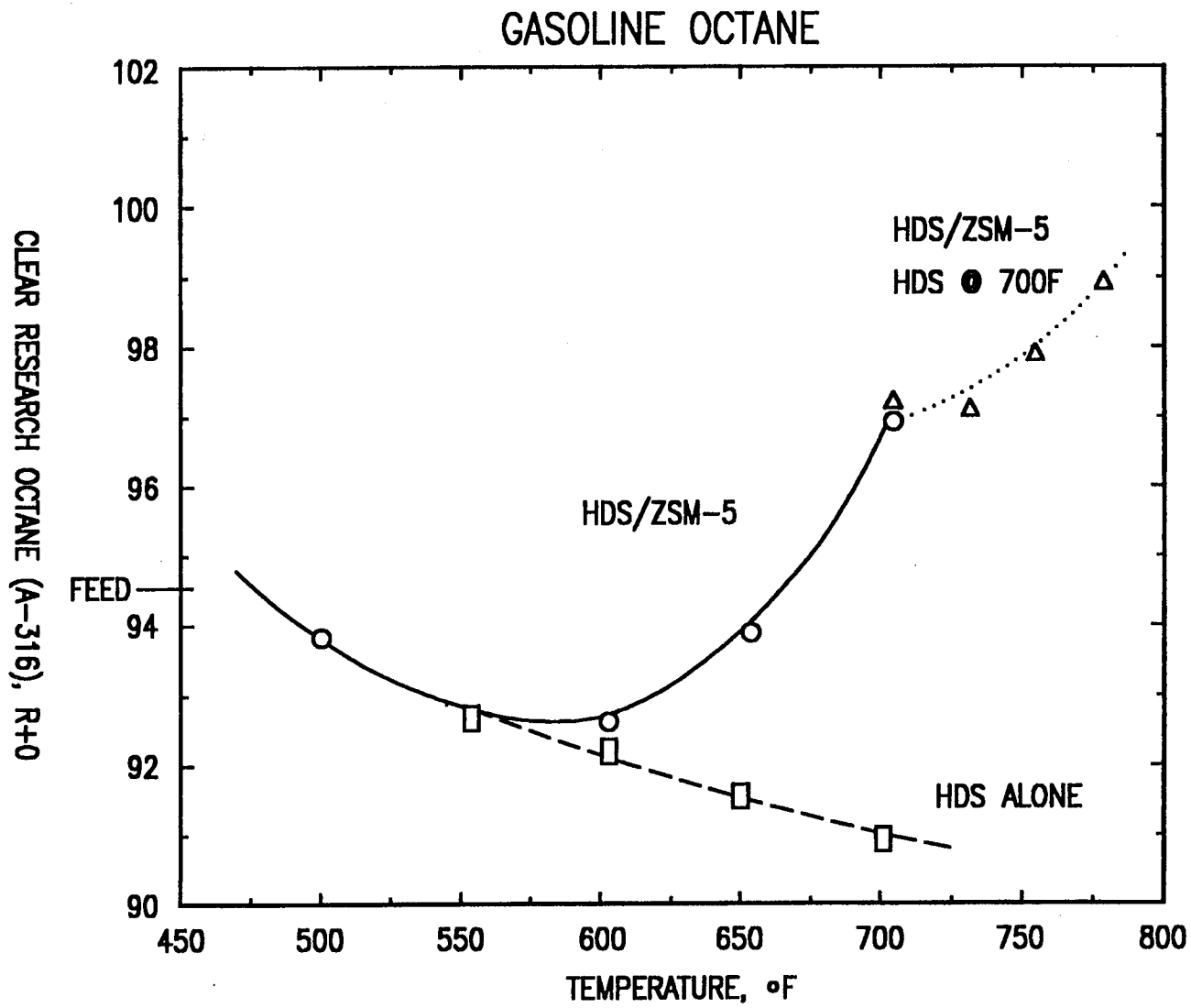
FIG. 2 is a series of plots of the octane number of the product as a function of the operating temperature.

These examples were run with only a hydrodesulfurization reaction zone. At a reaction temperature of 550° F., the product had a sulfur content of about 300 ppmw, and a clear research octane of about 92.5. As the temperature of the desulfurization was increased, the sulfur content and the octane number continued to decline. Reference is here made to FIGS. 1 and 2.

EXAMPLES OF HYDRODESULFURIZATION COUPLED WITH ZSM-5 UPGRADING WITH BOTH BEDS AT THE SAME AVERAGE TEMPERATURE

In these examples, the hydrodesulfurization was run in cascade with ZSM-5 upgrading without intermediate hydrogen sulfide separation. At a reaction temperature of 550° F., the product had slightly higher or about the same sulfur content as the hydrodesulfurization alone, that is a sulfur content of about 300 ppmw, and about the same clear research octane of about 92.5. As the temperature of the desulfurization was increased to 600° F., the sulfur content of the product declined to about 200 ppmw, below that of the hydrodesulfurization alone; and the octane number started to increase for the cascade operation as compared to the hydrodesulfurization alone. Reference is also here made to FIGS. 1 and 2.

Note should be taken of the fact that where the operation was carried out at an operating temperature of 685° F., the octane number of the finished product was substantially the same as that of the feed naphtha, that is 95.6 (clear-research), which is 4.6 octane units higher than the octane number for the same operation using only hydrodesulfurization without second step upgrading, while meeting the desired sulfur content specifications. Further note should be taken that this sulfur content may be actually be higher than can be expected in commercial operations. It may in fact be an aberration caused by the cascade operation. At the lower temperature cascade operations, it is possible that mercaptans may have been formed by the reaction of the hydrocarbon products and the hydrogen sulfide atmosphere. In an operation in which hydrogen sulfide is removed between the hydrodesulfurization step and the upgrading with a zeolitic behaving catalyst, such mercaptans would not be formed to any appreciable extent.

EXAMPLES OF HYDRODESULFURIZATION COUPLED WITH ZSM-5 UPGRADING WITH THE HYDRODESULFURIZATION BED AT AN AVERAGE TEMPERATURE OF 700° F. AND THE ZSM-5 BED AT A HIGHER TEMPERATURE SUFFICIENT TO OBTAIN MAXIMUM OCTANE ENHANCEMENT

Under the conditions of operation in this set of examples, with the ZSM-5 bed operated at 775° F. the octane of the product gasoline was increased to 99 (clear research). The desulfurization of these runs were sufficient to meet specifications. Reference is here made to FIGS. 1 and 2.

Figure 3:
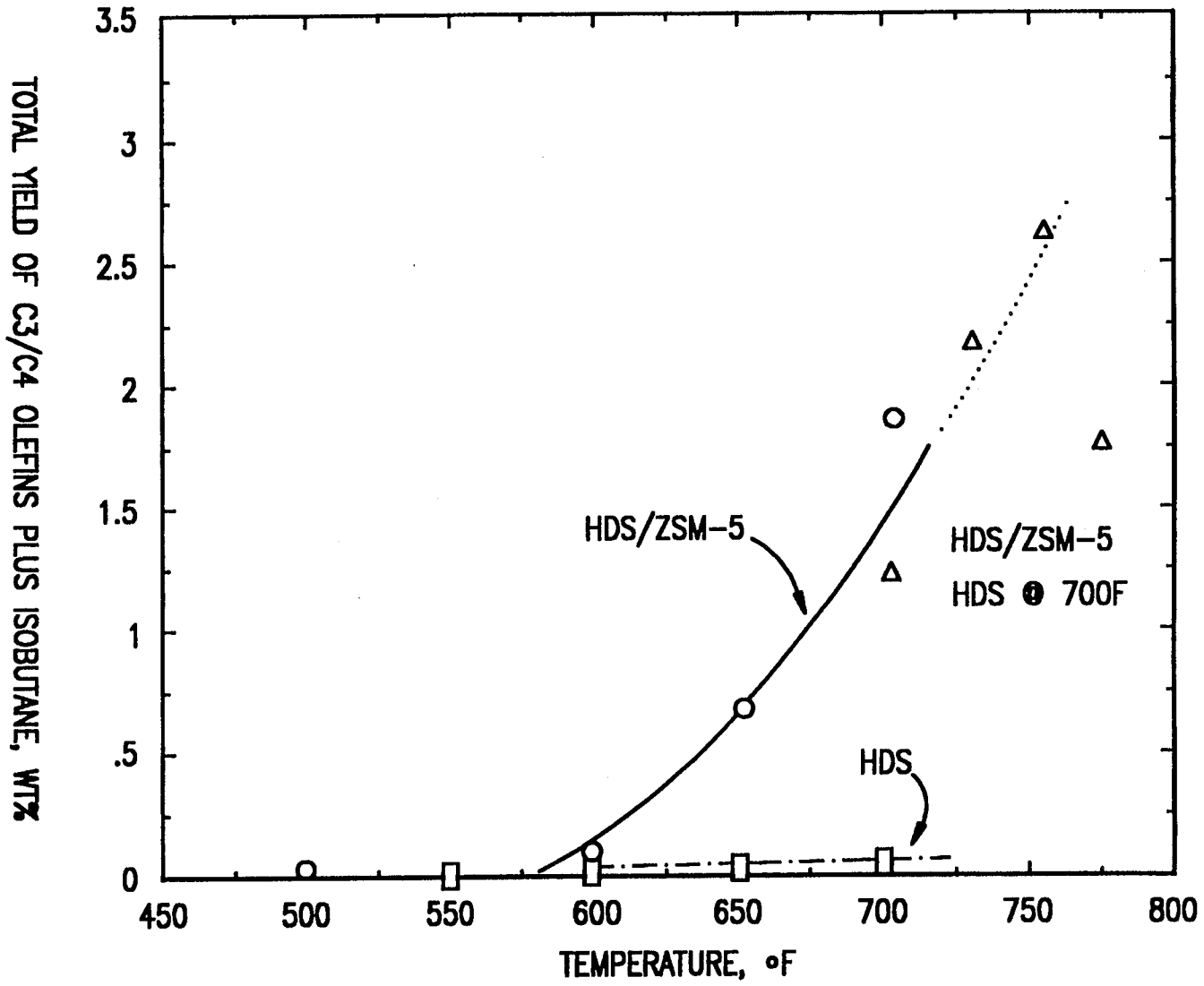
FIG. 3 is a plot of the yield of $C_3/C_4$ olefins plus isobutene as a function of the operating temperature.

It should be noted that when operating with two catalysts, suitably in tandem beds, as set forth in this invention, there is a substantial production of propylene, butenes and isobutane. Reference is here made to FIG. 3 of the accompanying drawing showing the yields of these materials as a function of the operating temperatures and the reaction process schemes. Using hydrodesulfurization alone, it will be apparent that substantially no $C_3$ and $C_4$ compounds are produced in this operation. By contrast, with the combination process of this invention, whether operated at constant temperature or with the ZSM-5 bed at higher temperature, there is a substantial quantity of these light materials formed, and the proportion formed increases with temperature.

Therefore, operating the process of this invention at progressively higher temperatures increases the production of desirable light fractions, increases the octane number of the gasoline boiling range product fractions, and effectively desulfurizes the gasoline boiling range product to a sufficient extent. These are all the desirable attributes of this invention.

EXAMPLES OF COMBINED HYRDODESULFURIZATION AND ZEOLITIC BEHAVING CATALYST UPGRADING FOR FEEDS OF NAPHTHAS OF DIFFERENT BOILING RANGES

The following examples demonstrate the practice of this invention using feeds of different boiling ranges. Reference is made to table 3 which should be considered in combination with the following remarks. In these examples, the feed was cascaded from the first stage hydrodesulfurization to the second stage upgrading with a zeolitic behaving catalyst without intermediate separation between to two stages. The intermediate product resulting from the hydrodesulfurization stage conversion had properties, including sulfur content and octane number, which were consistent with the properties of the same type of feed converted in a conventional commercially operating hydrotreater. The product resulting from the second stage upgrading has physical properties, including sulfur content and octane number, which demonstrate the improvement obtained by the practice of this invention.

A full range FCC naphtha was hydrodesulfurized in cases 1 and 2 in a first reaction zone at 700° F. There was substantially complete sulfur removal from the feed at a substantial loss in octane number. In case 1, the second stage zeolitic upgrading was carried out under relatively mild conditions and served to minimize the loss of octane. In case 2, operating the second stage conversion at higher severity caused the octane number of the final product to more closely approach that of the feed. Cases 3 and 4 show the same results achieved with a feed of somewhat heavier FCC naphtha.

TABLE 3

Hydrodesulfurization and ZSM-5 Upgrading of Various FCC Naphtha Cuts

Conditions: 0.84 LHSV, 3200 SCF/bbl Hydrogen, 600 psig

| Cases | 1 | 2 | 3 | 4 |
|---|---|---|---|---|
| Reactor 1 Temp., °F. | 700 | 700 | 700 | 700 |
| Reactor 2 Rwmp., °F. | 700 | 750 | 700 | 750 |
| Feed | | | | |
| Boiling Range, °F. | 95–500 | 95–500 | 230–500 | 230–500 |
| API Gravity | 54.3 | 54.3 | 34.2 | 34.2 |
| Sulfur, ppmw | 3800 | 3800 | 5200 | 5200 |
| Nitrogen, ppmw | 44 | 44 | 85 | 85 |
| Bromine No. | 45.81 | 45.81 | 13.86 | 13.86 |
| Research Octane | 93.5 | 93.5 | 95.8 | 95.8 |
| Motor Octane | 81.6 | 81.6 | 83.5 | 83.5 |
| Wt % $C_{5++}$ | 99.8 | 99.8 | 100.0 | 100.0 |
| Vol % $C_5$ | 99.8 | 99.8 | 100.0 | 100.0 |
| Reactor 1 Product | | | | |
| Sulfur, ppmww | <20 | <20 | <20 | <20 |
| Nitrogen, ppmw | 2 | 2 | <1 | <1 |
| Bromine No. | 0.11 | 0.11 | 0.03 | 0.03 |
| Research Octane | 80.8 | 80.8 | 89.3 | 89.3 |
| Motor Octane | 75.3 | 75.3 | 78.4 | 78.4 |
| Wt % $C_5$ | 99.2 | 99.2 | 100.2 | 100.2 |
| Vol % $C_{5+}$ | 97.6 | 97.6 | 102.2 | 102.2 |
| Vol % $C_3$ Olefins | 0.0 | 0.0 | 0.0 | 0.0 |
| Vol % $C_4$ Olefins | 0.0 | 0.0 | 0.0 | 0.0 |
| Vol % Isobutane | 0.0 | 0.0 | 0.0 | 0.0 |
| Potential Alkylate, vol %(1) | 0.0 | 0.0 | 0.0 | 0.0 |
| Reactor 2 Product | | | | |
| Sulfur, ppmw | <20 | <20 | <20 | <20 |
| Nitrogen, ppmw | <1 | <1 | <1 | <1 |
| Bromine No. | 1.63 | 1.49 | 1.51 | 0.91 |
| Research Octane | 87.4 | 92.9 | 93.2 | 97.3 |
| Motor Octane | 80.2 | 84.5 | 82.0 | 86.2 |
| Wt % $C_5$ | 94.9 | 82.7 | 97.3 | 91.0 |
| Vol % $C_{5+}$ | 92.5 | 80.4 | 98.7 | 91.7 |
| Vol % $C_3$ Olefins | 0.2 | 0.3 | 0.2 | 0.3 |
| Vol % $C_4$ Olefins | 0.4 | 0.4 | 0.5 | 0.4 |
| Vol % Isobutane | 1.6 | 5.8 | 1.0 | 3.7 |
| Potential Alkylate, Vol % | 1.0 | 1.2 | 1.2 | 1.2 |

(1)Potential alkylate defined as $1.7 \times (C_4^{=} + C_3^{=}$, % vol).

EXAMPLES OF THE EFFECT OF HYDROTREATING SEVERITY ON UPGRADING CRACKED NAPHTHA OVER A ZEOLITIC BEHAVING CATALYST

The following examples demonstrate the importance of having both a first stage hydrotreater and a second stage zeolitic upgrading to the practice of the present invention. Reference is made to table 4 in conjunction with these examples.

Case 1 demonstrates the results of upgrading cracked naphtha with a zeolitic behaving catalyst (ZSM-5) without prior hydrotreatment. During the experiment, the temperature of the first reactor was 350° F., which is sufficiently low to make this stage hydrotreating ineffective and made this first stage merely a pre-heater. The second stage alone did not remove the required amount of sulfur.

In Case 2, mild hydrotreatment prior in the first stage did achieve the required desulfurization. However, the first stage of hydrotreatment completely saturated the olefins in the feed, as indicated by the bromine number reduction, and this resulted in a 9 number loss of research octane. The second stage processing over the zeolitic behaving catalyst restored the lost octane.

The first case (case 1) set forth in table 4 demonstrates the results of upgrading cracked naphtha with a zeolitic behaving catalyst (ZSM-5) alone, without prior hydrotreatment. During this run, because of the configuration of the experimental equipment, the feed was passed through the first stage as well as the second stage, but the temperature of the first stage was maintained at 350° F., which is so low that no measurable hydrotreating took place in this stage. The first stage then actually behaved as if it was simply a preheater, with the first stage catalyst having substantially no effect. The reported results show that the operation of the second stage alone, that is the stage catalyzed by a zeolitic behaving catalyst, did not cause sufficient sulfur to be removed from the feed to meet required specifications.

The second case (case 2) processed the same feed through the same two stages, but the temperature of the first stage was increased an amount sufficient for hydrotreating to take place in this stage. It will be apparent, from a consideration of the bromine number of the intermediate product reported in table 4, that in addition to removing the required amount of sulfur from the feed, the first stage hydrotreating also substantially saturated the olefin content of the feed, causing a reduction of 9 research octane numbers. However, according to the practice of this invention, the second stage conversion over the zeolitic behaving catalyst restored this lost octane.

TABLE 4

Effect of Hydrotreating Severity on ZSM-5 Upgrading of FCC Naphtha

Conditions: 0.84 LHSV, 3200 SCF/bbl hydrogen, 600 psig

| Case | 1 | 2 |
|---|---|---|
| Reactor 1 Temp., °F. | 350 | 550 |
| Reactor 2 Temp., °F. | 700 | 700 |
| Feed | | |
| Boiling Range, °F. | 95–500 | 95–500 |
| API Gravity | 54.3 | 54.3 |
| Sulfur, ppmw | 3800 | 3800 |
| Nitrogen, ppmw | 44 | 44 |
| Bromine No. | 45.81 | 45.81 |
| Research Octane | 93.5 | 93.5 |
| Motor Octane | 81.6 | 81.6 |
| Wt % $C_5$+ | 99.8 | 99.8 |
| Vol % $C_5$+ | 99.8 | 99.8 |
| Reactor 1 Product | | |
| Sulfur, ppmw | — | <20 |
| Nitrogen, ppmw | — | 3 |
| Bromine No. | — | 0.08 |
| Research Octane | — | 84.5 |
| Motor Octane | — | 76.8 |
| Wt % $C_5$+ | — | 99.3 |
| Vol % $C_5$+ | — | 96.2 |
| Vol % $C_3$ Olefins | — | 0.0 |
| Vol % $C_4$ Olefins | — | 0.0 |
| Vol % Isobutane | — | 0.0 |
| Potential Alkylate Vol % | — | 0.0 |

TABLE 4-continued

Effect of Hydrotreating Severity on ZSM-5 Upgrading of FCC Naphtha

Conditions: 0.84 LHSV, 3200 SCF/bbl hydrogen, 600 psig

| Case | 1 | 2 |
|---|---|---|
| Reactor 2 Product | | |
| Sulfur, ppmw | 1700 | 30 |
| Nitrogen, ppmw | 25 | <1 |
| Bromine No. | 12.70 | 1.40 |
| Research Octane | 94.0 | 90.0 |
| Motor Octane | 83.7 | 82.0 |
| Wt % $C_5$+ | 94.3 | 94.7 |
| Vol % $C_5$+ | 88.8 | 92.0 |
| Vol % $C_3$ Olefins | 0.5 | 0.2 |
| Vol % $C_4$ Olefins | 1.1 | 0.4 |
| Vol % Isobutane | 1.9 | 1.6 |
| Potential Alkylate vol % | 2.7 | 1.0 |

What is claimed is:

1. A process of upgrading a sulfur containing hydrocarbon comprising a catalytically cracked naphtha feed fraction comprising olefins and boiling in the gasoline boiling range, the feed fraction being selected from a naphtha having a boiling range in the range of $C_6$ to 330° F., a naphtha having a boiling range in the range of $C_5$ to 420° F., a naphtha having a boiling range in the range of 260° to 412° F. or a naphtha boiling in the range of 330° to 500° F., which comprises:

contacting such sulfur containing naphtha feed fraction with a hydrodesulfurization catalyst in a first reaction zone, operating under a combination of elevated temperature, elevated pressure and an atmosphere comprising hydrogen, such as to produce a first intermediate reaction zone product comprising a normally liquid fraction which has a reduced sulfur content and a reduced octane number as compared to the feed;

cascading the first intermediate reaction zone product to a second reaction zone and contacting the first intermediate product in the second reaction zone in the presence of hydrogen with a different catalyst, comprising a zeolitic behaving refractory solid having an acid activity equivalent to at least about 20 alpha, and a topology such that, in the aluminosilicate form, it would have a constraint index of 2 to 12; under a combination of conditions comprising elevated temperature of from 700° to 800° F., sufficient to convert said first intermediate product fraction boiling in the gasoline boiling range to a product comprising a fraction boiling in the gasoline boiling range having a higher octane number than said first intermediate gasoline boiling range fraction; and recovering at least said upgraded gasoline boiling range product fraction.

2. The process as claimed in claim 1 wherein said feed fraction comprises a light naphtha fraction having a boiling range within the range of $C_6$ to 330° F.

3. The process as claimed in claim 1 wherein said feed fraction comprises a full range naphtha fraction having a boiling range within the range of $C_5$ to 420° F.

4. The process as claimed in claim 1 wherein said feed fraction comprises a heavy naphtha fraction having a boiling range within the range of 330° to 500° F.

5. The process as claimed in claim 1 wherein said feed fraction comprises a heavy naphtha fraction having a boiling range within the range of 330° to 412° F.

6. The process as claimed in claim 1 wherein said different catalyst in said second reaction zone comprises a zeolite behaving refractory solid having a topology substantially corresponding to the topology of at least one member of the group consisting of ZSM-5, ZSM-11, ZSM-22, ZSM-23, ZSM-35, ZSM-50, and MCM-22.

7. The process as claimed in claim 6 wherein said different catalyst comprises a zeolite behaving refractory solid having a topology substantially corresponding to the topology of ZSM-5 in an aluminosilicate form.

8. The process as claimed in claim 1 wherein said different catalyst comprises said zeolite behaving refractory solid in combination with a binder.

9. The process as claimed in claim 8 wherein said binder is at least one member selected from the group consisting of silica, alumina, silica-alumina, silica-zirconia, and silica-titania.

10. The process as claimed in claim 1 wherein said hydrodesulfurization catalyst comprises a group VIII metal.

11. The process as claimed in claim 10 wherein said hydrodesulfurization catalyst comprises a group VIII and a group VI metal.

12. The process as claimed in claim 1 wherein said hydrodesulfurization catalyst comprises cobalt and molybdenum carried on an alumina substrate.

13. The process as claimed in claim 1 wherein said hydrodesulfurization is carried out at a temperature of about 400° to 800° F., a pressure of about 50 to 1500 psig, a space velocity of about 0.5 to 10 LHSV, and a hydrogen to hydrocarbon ratio of about 500 to 5000 standard cubic feet of hydrogen per barrel of feed.

14. The process as claimed in claim 1 wherein said hydrodesulfurization is carried out at a temperature of about 500° to 750° F., a pressure of about 300 to 1000 psig, a space velocity of about 1 to 6 LHSV, and a hydrogen to hydrocarbon ratio of about 1000 to 2500 standard cubic feet of hydrogen per barrel of feed.

15. The process as claimed in claim 1 wherein the second stage upgrading is carried out at a temperature of about 700° to 900° F., a pressure of about 50 to 1500 psig, a space velocity of about 0.5 to 10 LHSV, and a hydrogen to hydrocarbon ratio of about 0 to 5000 standard cubic feet of hydrogen per barrel of feed.

16. The process as claimed in claim 1 wherein the second stage upgrading is carried out at a temperature of about 700° to 800° F., a pressure of about 300 to 1000 psig, a space velocity of about 1 to 6 LHSV, and a hydrogen to hydrocarbon ratio of about 100 to 2500 standard cubic feet of hydrogen per barrel of feed.

17. The process as claimed in claim 1 including additionally recovering from said second stage product, a normally gaseous fraction boiling below $C_5$, and alkylating at least the $C_4$ unsaturated portion thereof into a normally liquid hydrocarbonaceous product having a high octane number and boiling in the gasoline boiling range.

18. The process as claimed in claim 17 including blending said alkylate with said upgraded gasoline boiling range fraction.

* * * * *

UNITED STATES PATENT AND TRADEMARK OFFICE

CERTIFICATE OF CORRECTION

PATENT NO. : 5,346,609

DATED : September 13, 1994

INVENTOR(S) : D. L. Fletcher et al.

It is certified that error appears in the above-indentified patent and that said Letters Patent is hereby corrected as shown below:

Column 16:

Claim 15 delete "900°F" and insert "800°F"

Signed and Sealed this

Twenty-seventh Day of December, 1994

*Attest:*

Bruce Lehman

BRUCE LEHMAN

*Attesting Officer*

*Commissioner of Patents and Trademarks*